US006268836B1

(12) United States Patent
Faulkner et al.

(10) Patent No.: US 6,268,836 B1
(45) Date of Patent: Jul. 31, 2001

(54) ANTENNA ASSEMBLY ADAPTED WITH AN ELECTRICAL PLUG

(75) Inventors: Scott Anthony Faulkner, Harrisburg, PA (US); Lawrence Steven Gans, Exeter, NH (US); John Eugene Westman, Harrisburg, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/417,248

(22) Filed: Oct. 13, 1999

Related U.S. Application Data

(60) Provisional application No. 60/131,375, filed on Apr. 28, 1999, and provisional application No. 60/131,376, filed on Apr. 28, 1999.

(51) Int. Cl.[7] ..... H01Q 1/36
(52) U.S. Cl. ..... 343/895; 343/702
(58) Field of Search ..... 343/895, 702, 343/715, 906, 900, 901

(56) References Cited

U.S. PATENT DOCUMENTS

| | | | | |
|---|---|---|---|---|
| 4,097,867 | * | 6/1978 | Eroncig | 343/715 |
| 5,469,177 | * | 11/1995 | Rush et al. | 343/702 |
| 5,559,524 | | 9/1996 | Takei et al. | 343/895 |
| 5,603,630 | | 2/1997 | Villain | 439/347 |
| 5,650,789 | * | 7/1997 | Elliott et al. | 343/702 |
| 5,807,123 | | 9/1998 | Spiegelaar et al. | 439/188 |
| 5,825,330 | * | 10/1998 | Na et al. | 343/702 |
| 5,926,138 | * | 7/1999 | Eerikainen | 343/702 |
| 5,945,952 | * | 8/1999 | Davidson | 343/702 |
| 5,949,386 | * | 9/1999 | Elliott | 343/906 |
| 5,950,116 | * | 9/1999 | Baro | 455/90 |
| 6,057,807 | * | 5/2000 | Marthinson et al. | 343/895 |

FOREIGN PATENT DOCUMENTS

| | | | |
|---|---|---|---|
| 298 11 273 U1 | 10/1998 | (DE) | H01Q/1/38 |
| 2 330 951 | 5/1999 | (GB) . | |

OTHER PUBLICATIONS

Abstract & Drawings Only, U.S. application No. 09/206,445, filed Dec. 7, 1998.

* cited by examiner

*Primary Examiner*—Don Wong
*Assistant Examiner*—Trinh Vo Dinh

(57) ABSTRACT

An antenna assembly (40) has a mast (44) on which is supported a radiating antenna element (14), the mast (44) being shaped to comprise an electrical plug (48) on which is supported an electrical contact (400) that connects to an antenna feed line (18) for the radiating antenna element (14), the electrical plug 48 adapting the antenna assembly (40) for mating connection with an electrical socket, and the electrical plug (48) providing a mounting structure for the mast (44).

10 Claims, 6 Drawing Sheets

ANTENNA ASSEMBLY ADAPTED WITH AN ELECTRICAL PLUG

This appln claims benefit of provisional Nos. 60/131,375 filed Apr. 28, 1999 and 60/131,376 filed Apr. 28, 1999.

FIELD OF THE INVENTION

The invention relates to an antenna assembly, and, more particularly, to an antenna assembly that is adapted with an electrical plug.

BACKGROUND OF THE INVENTION

An antenna assembly for supporting a coil antenna element is disclosed in U.S. patent application Ser. No. 09/206,445. Disadvantages of a coil antenna element include the difficulty of replicating a coil of precise dimensions and proper frequency band tuning, as well as mounting the coil in fixed position on an antenna mast without the coil changing shape over the passage of time and in response to temperature fluctuations and vibration and impact. A further difficulty arises in providing electrical connections to a coil, and to an antenna feed line for the coil, as well as providing a mechanical mounting structure for mounting the coil to an antenna mast. Further, a need exists for mounting the mast to a communications device, for example, a personal communications device that communicates by cellular telephone frequency bands and/or PCS, personal communications services, frequency bands.

A need exists for an antenna assembly that supports a radiating antenna element in fixed position over the passage of time and without changes in shape over time and in response to temperature fluctuations, vibration and impact.

Another need exists for an antenna assembly that provides an electrical connection and a mechanical connection for an antenna mast on which the radiating antenna element is supported.

SUMMARY OF THE INVENTION

The present invention provides an antenna assembly having a mast on which is supported a radiating antenna element, the mast being shaped to comprise an electrical plug on which is supported an electrical contact that connects to an antenna feed line for the radiating antenna element. Advantageously, the electrical plug adapts the antenna assembly for mating connection with an electrical socket, and provides a mounting structure for the mast.

The invention satisfies the need for an antenna assembly that provides an electrical connection and a mechanical connection for an antenna mast on which the radiating antenna element is supported.

The invention satisfies the further need for an antenna assembly that supports a radiating antenna element in fixed position over the passage of time and without the antenna element changing shape, over the passage of time, and in response to temperature fluctuations, vibration and impact.

An embodiment of the present invention provides an antenna assembly that has an insulating antenna mast supporting a radiating antenna element and a radome covering the antenna element, the antenna element having an antenna feed line, an electrical contact connected to the antenna feed line, the antenna mast being shaped to comprise an electrical plug on which the electrical contact is supported, and the contact extending along the electrical plug for making an electrical connection with an electrical socket when the electrical plug is matingly connected to the electrical socket.

DESCRIPTION OF THE DRAWINGS

An embodiment of the invention will now be described by way of example with reference to the accompanying drawings, according to which.

DETAILED DESCRIPTION

Figure 4:
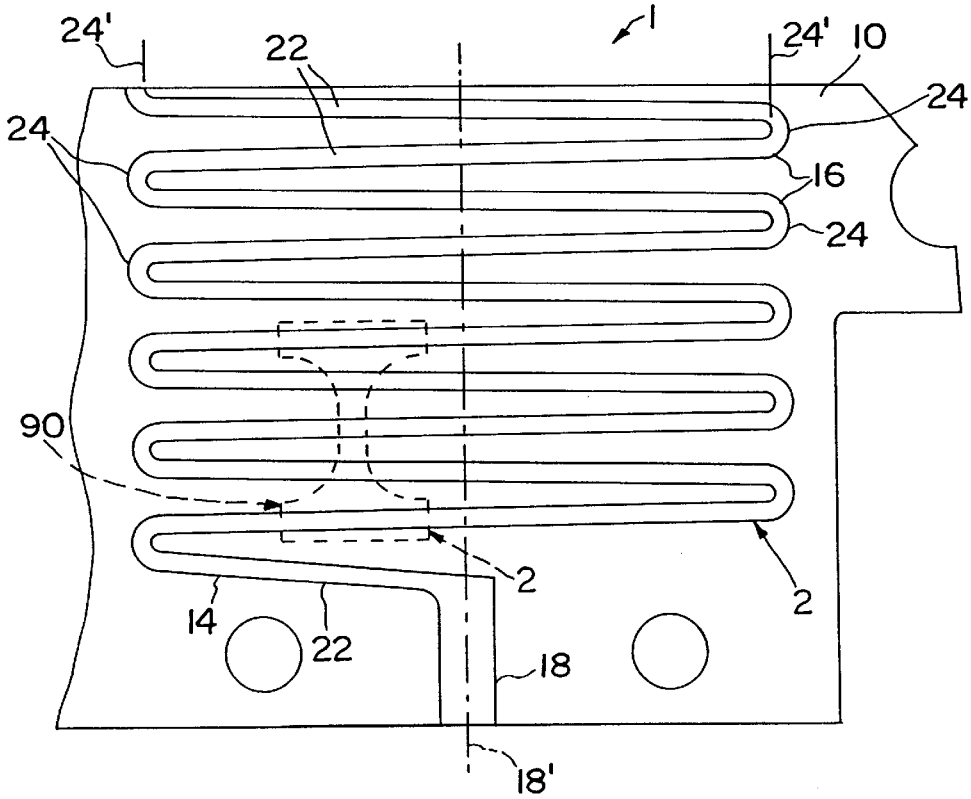
FIG. 4 is an enlarged top view of a radiating antenna element and a feed line on a film, and a capacitive load element shown in phantom outline.

The invention will now be described with similar features among the various embodiments being referenced with the same numerals. With more particular reference to FIGS. 9 and 11, an antenna element 1 comprises a film 10, also referred to as a film element, of dielectric material having thereon a radiating antenna element 14, also referred to as a trace. With reference to FIG. 4, the film 10 has thereon a capacitive load element 90, also referred to as a parasitic trace, that are capacitively coupled to provide a dual band antenna element 1.

The radiating antenna element 14 is connected with a unitary antenna feed line 18, also referred to as a tail portion, extending from an edge of the film 10. The radiating antenna element 14 has multiple straight radiating elements 22, also referred to as arms, that intersect one to another at respective angles, and that are connected one to another electrically in series and in reverse directions of current flow along a reversing zig zag pattern 16, also referred to as a zig zag portion. The radiating elements 22 intersect one to another at sharply angled corners 24 along the reversing zig zag pattern 16.

For example, the radiating antenna element 14 has the following dimensions. Each straight radiating element 22 has a conducting transmission line width of 0.50 mm. that is also the conducting width of each of the corners 24. The feed line 18 has a center axis 18' that intersects the midpoint of each of the straight radiating elements 22. The inside edges of the corners 24 are along lines 24' that are 17 mm. apart, the lines 24' being parallel to the axis 18' of the feed line 18. Each of the corners 24 has an inside radius of 0.26 mm. and an outside radius of 0.76 mm., with a common center of radius. The centers of radius, which correspond to successive corners 24, are on respective transverse axes that are spaced at increments of 1.25 mm. along the axis of the feed line 18. The corners 24, being positioned as described, determine the angles at which the straight radiating elements 22 intersect one to another.

Figure 5:
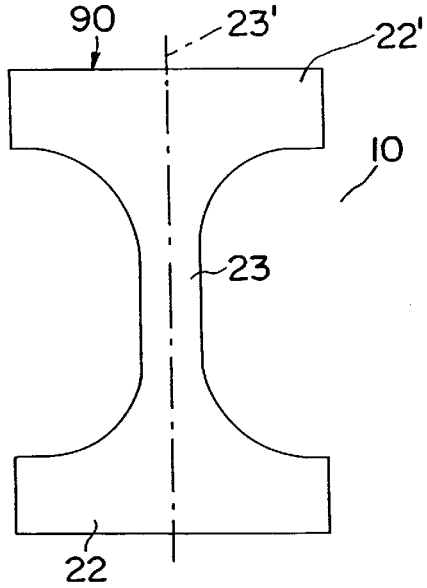
FIG. 5 is an enlarged top view of a capacitive load element on a film.

With reference to FIG. 5, the capacitive load element 90 is of unitary construction, and has a pair of straight conducting load elements 22', also referred to as first and second ends, interconnected by a transmission line 23 along a center axis 23' interconnecting the load elements 22' at their midpoints. The axes 23', 18' are parallel. With further reference to FIG. 4, the radiating antenna element 14 and the capacitive load element 90 are superposed, with the transmission line 23 of the capacitive load element 90 being parallel to the axis of the feed line 18. Further, the load elements 22' of the capacitive load element 90 are parallel with and are superposed with respective straight radiating elements 22 of the radiating antenna element 14 that conduct current in reverse directions along the zig zag pattern 16.

Figure 11:
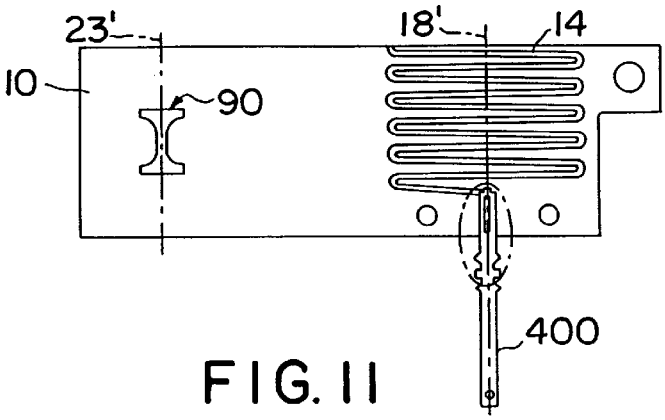
FIG. 11 is a plan view of another embodiment of an antenna element.

According to an embodiment, as shown further with reference to FIG. 4, the radiating antenna element 14 and the capacitive load element 90 are on opposite sides of the film 10. According to another embodiment as shown in FIG. 11, the radiating antenna element 14 and the capacitive load element 90 are on the same side of the film 10. The center axes 18' and 23' of the two elements 14, 90 are spaced apart $\pi D$, where D is the diameter of a sleeve having a cylindrical shape. The embodiment of a capacitive load element 90, on the same side of the film 10 as the radiating antenna element 14, is a mirror image of an embodiment of the capacitive load element 90, of the same shape, that would be provided on an opposite side of the film 10 from the radiating antenna element 14.

According to the embodiment shown in FIG. 11, the radiating antenna element 14 and the capacitive load element According to the embodiment shown in FIG. 11, the radiating antenna element 14 and the capacitive load element 90 are superposed, for example, by having the film 10 being rolled to a cylindrical sleeve shape, with the film 10 overlapping itself to superpose the antenna elements 14 and capacitive load element 90, with their center axes 23', 18' aligned. The capacitive load element 90 is positioned to face a side of the film 10 that is opposite to the side of the film 10 having thereon the radiating antenna element 14, such that the radiating antenna element 14 and the capacitive load element 90 are capacitively coupled across the thickness of the film 10. Further, the film 10 in a sleeve shape aligns the conducting load elements 22' of the capacitive load element 90 parallel with, and superposed with, respective straight radiating elements 22 of the radiating antenna element 14 that conduct current in reverse directions along the zig zag pattern 16.

For example, the capacitive load element 90, FIG. 5, has the following dimensions. The transmission line 23 has a width of 0.75 mm. The overall length of the capacitive load element 90 axially along the transmission line 23 is 6 mm. The conducting load elements 22' are along an angle of 0°–30°. Each of the load elements 22' join the transmission line with a radius of 1.5 mm., at one rounded corner, and a radius of 1.2 mm. at a second rounded corner. The opposite ends of the load elements 22' are each 1 mm. wide.

Figure 12:
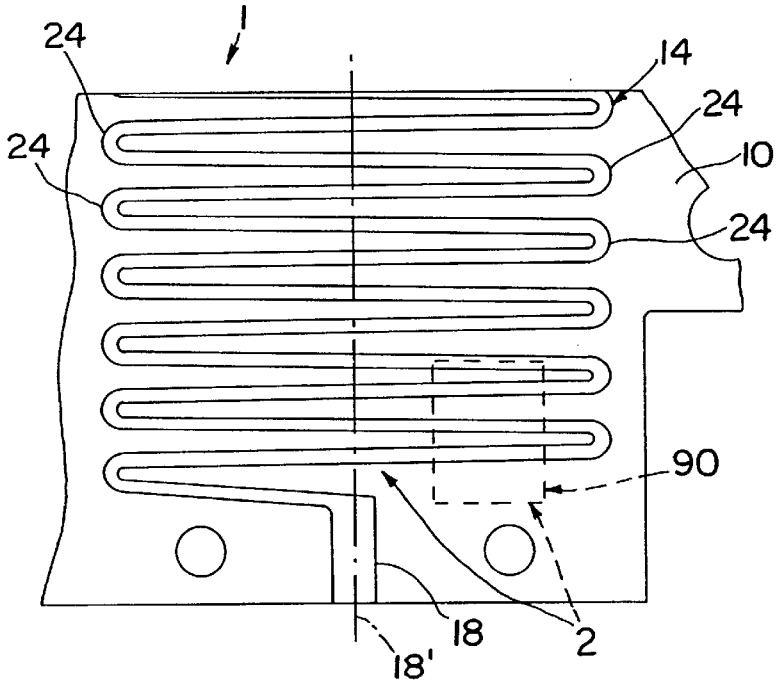
FIG. 12 is a plan view of another embodiment of an antenna element.
Figure 13:
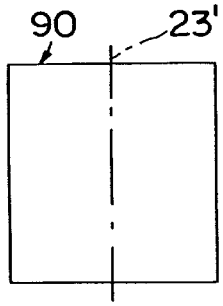
FIG. 13 is a planner development of a capacitive load element of the embodiment as shown in FIG. 12.

Another embodiment is shown further with reference to FIGS. 12 and 13. With reference to FIG. 13, the capacitive load element 90 is of unitary construction, and has a rectangular shape, 3.75 mm. width and 5 mm. vertical length. FIG. 12 illustrates the radiating antenna element 14 and the capacitive load element 90 in desired superposed positions. The radiating antenna element 14 and the capacitive load element 90 are separated by a thickness of the film 10, which provides capacitive coupling, also referred to as parasitic coupling and as reactive coupling, of the capacitive load element 90 and the radiating antenna element 14 across the thickness of the film 10.

For the embodiment of FIG. 11, the film 10 is rolled into a sleeve or cylindrical shape that has a central axis that is parallel to the axis 18' of the feed line 18.

The reversing current flows, along the angles of the radiating elements 22 of each radiating antenna element 14 are resolved into horizontal and vertical vector components. The horizontal components tend to cancel, due to current flows in opposing directions. The radiated signal is vertically polarized, as the sum of the vertical components.

The sharply angled corners 24 are free of pointed corners to provide smooth phase reversals of current propagating along the reversing zig zag pattern, and to minimize voltage standing wave reflections of significance, which increases the gain of the signal being propagated.

Each of FIGS. 4 and 12 illustrates the radiating antenna element 14 and the capacitive load element 90 in desired superposed positions. The radiating antenna element 14 and the capacitive load element 90 are separated by a thickness of the film 10, which provides capacitive coupling, also referred to as parasitic coupling and as reactive coupling, of the capacitive load element 90 and the radiating antenna element 14 across the thickness of the film 10.

The radiating antenna element 14 radiates a microwave signal of first order harmonic frequency within a desired lower frequency band, with each of the radiating elements 22 being of a length which resonates at the first order harmonic frequency. The radiating antenna element 14 further tends to radiate at a second order harmonic frequency. However, at the second order harmonic frequency, the conducting load elements 22' of the capacitive load element 90, capacitively couple to the respective radiating elements 22 of the radiating antenna element 14, applying a capacitive load that tunes the radiated second order harmonic frequency with a broad frequency band that corresponds to a desired, second frequency band of microwave signals. Thus, a dual band antenna element 1 is provided by having the radiating antenna element 14 radiate a signal at a fixed first frequency comprising, the first order harmonic frequency that is within a desired first frequency band for communications signals, and having the radiating antenna element 14 being capacitively coupled with the capacitive load element 90 at a second order harmonic frequency that adjusts the characteristic impedance closer to 50 Ohms, which tunes the antenna element 14 to radiate at a broadened band of second order harmonic frequencies that are within a second frequency band for communications signals. Thus, the antenna element 1 becomes a dual band antenna element that operates within two frequency bands for communications signals, for example, cellular telephone frequency bands, and other frequency bands for PCS communications.

The sleeve shape, which was discussed in conjunction with the embodiment shown in FIG. 11, further provides the radiating elements 22 with curvature. The embodiment of FIG. 4 is usable with the film 10 and the elements 14 and 90 being either flat or with the film 10 having the radiating antenna element 14 and the capacitive load element 90 thereon, being rolled to a sleeve shape to provide the radiating elements 22 with curvature. In either shape, the radiating antenna element 14 radiates a signal nearly linearly polarized, but not perfectly linearly polarized, because, advantageously, the signal has relatively high cross polarization (90° from linear), which provides a desired radiation pattern.

Figure 3:
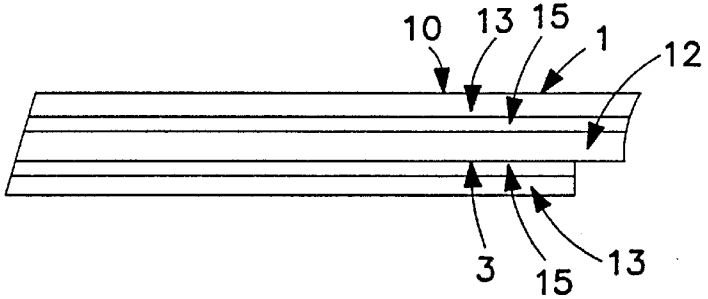
FIG. 3 is an enlarged fragmentary view of a portion of the film, as shown in FIG. 1.

With reference to FIG. 3, manufacture of the antenna element 1 will now be described with reference to the embodiment of FIG. 4, with an understanding that each of the embodiments of FIG. 4, FIG. 11 and FIG. 12, are manufactured similarly. Accordingly, to continue the description, the film 10 has a dielectric layer 12 covered by laminates of conducting layers 13 attached with respective layers of adhesive 15. For example, the dielectric layer 12 is 0.05 mm. thick. The dielectric layer 12 has a thickness that allows the dielectric layer 12 to be flexible, together with the layers 13 and adhesive 15. Each of the layers of adhesive 15 is 0.025 mm. thick. Each of the conducting layers 13 is 0.035 mm. thick. The conducting layers 13 are subjected to a subtractive process, for example, a photoetching process, according to which process, selected portions of both the conducting layers 13, and the layers of adhesive 15, are removed, and thereby subtracted, to leave the radiating antenna element 14 and the load element 90 on the film 10. For example, the layers 13 are subjected to masking, photoexposure and photodevelopment, followed by fluid etchants that remove the photodeveloped, selected portions by an etching process.

Manufacture of the antenna element 1 is alternatively provided by an additive process, according to which the dielectric layer 12 is subjected to electroless plating process, followed by an electroplating process, to add metal plating to form the radiating antenna element 14 and the load element 90 on the dielectric layer 12. For example, the plating is applied with fluid electrolytes of the metals to be added by the plating operations. Because fluids of etchants or plating electrolytes are used, the surface tensions of the fluids tend to form the fluid with smooth droplet edges, which assist in avoiding the formation of pointed edges on the corners 24.

The radiating antenna elements 14 and the capacitive loading element 90 are manufactured with precise, repeatable dimensions that are easily replicated. The elements 14, 90 remain unchanged in shape in response to vibration, temperature changes, impact and with the passage of time. By comparison, coiled wire monopole antenna elements have less precisely controlled dimensions and undergo changes in shape in response to vibration, temperature changes, impact and with the passage of time.

Figure 1:
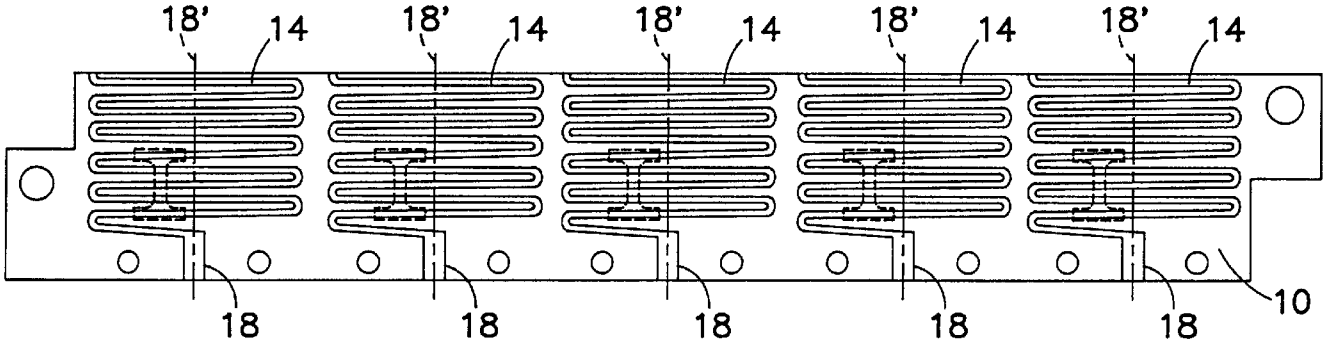
FIG. 1 is a top view of five radiating antenna elements on a film of insulating material.
Figure 2:
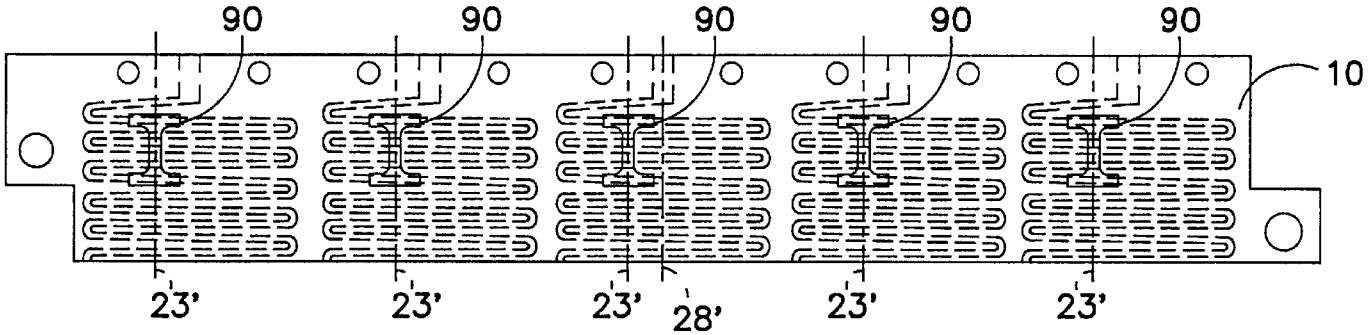
FIG. 2 is a top view of five capacitive load elements on the film, as shown in FIG. 1.
Figure 9:
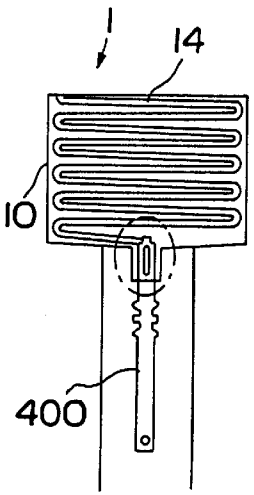
FIG. 9 is a plan view of an antenna element having a radiating antenna element and a contact connected to a feed line.
Figure 6:
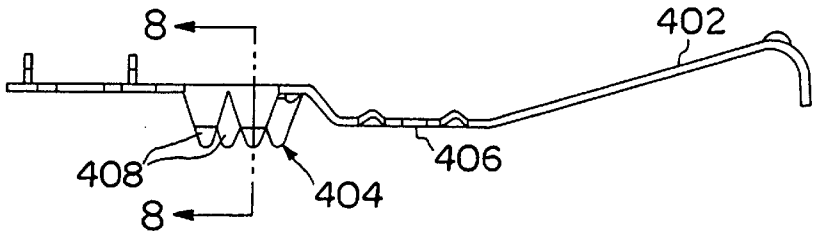
FIG. 6 is a side view of a contact for connection to the feed line, as shown in FIG. 4.
Figure 7:
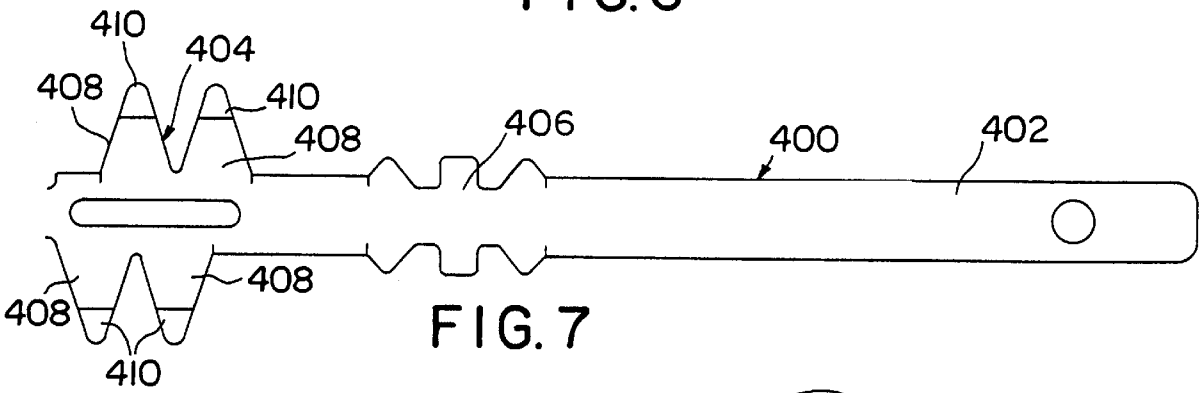
FIG. 7 is a view of a development of the contact as shown in FIG. 6.
Figure 10:
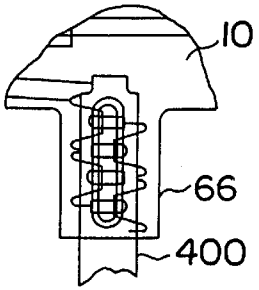
FIG. 10 is a fragmentary view of a reverse side of the contact connected to a feed line, as shown in FIG. 9.
Figure 8:
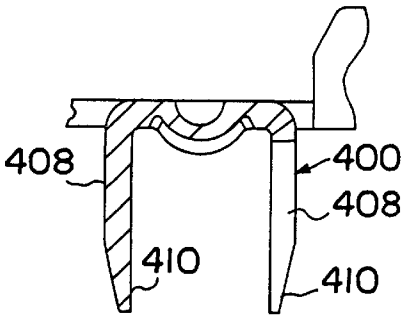
FIG. 8 is an enlarged section view of the contact as shown in FIG. 6.

With reference to FIGS. 1 and 2, multiple radiating antenna elements 14 and capacitive load elements 90 are provided along opposite sides of a strip of the insulating film 10. Contacts 400 are compression crimp connected on respective antenna feed lines. With reference to FIGS. 9, 10 and 11, the individual radiating elements 14 are cut out from the film 10 with a narrow leg 66 of the film supporting the antenna feed line 18 and the attached contact 400. With reference to FIGS. 6, 7 and 8, the contact 400 has a pin section 402 at one end for connection to external circuitry. A crimping section 404 extends from a body section 406 and includes arms 408 that penetrate the leg 66 of the film 10 and further, after penetrating the film 10, are bent over such that ends 410 of the arms 408 are pressed into the conductive antenna feed line 18, and pressing the film 10 and the feed line 18 against the body section 406, which mechanically and electrically connect the contact 40 and the radiating antenna element 14.

Figure 14:
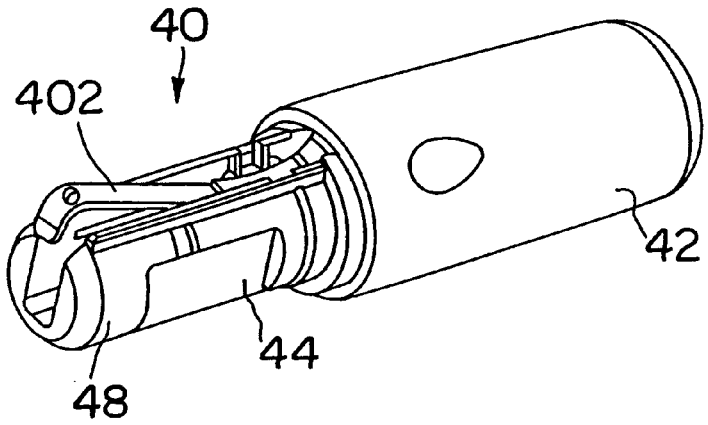
FIG. 14 is an isometric view of an antenna assembly.

With more particular reference to FIG. 14, an antenna assembly 40 comprises an antenna mast 44, also referred to as a dielectric body, supporting the antenna element 1 and a radome 42, also referred to as a cover or boot, of dielectric material. The electrical contact 400 that is connected to the antenna feed line 18 of the radiating antenna element 14 extends along the mast 44. The antenna mast 44 is of unitary construction, for example, a construction resulting from moulding an insulating plastics material.

The antenna mast 44 is shaped at a bottom end in the form of an electrical plug 48 along which the pin section 402 of the electrical contact 400 extends. The electrical plug 48 adapts the antenna assembly 40 for mating connection with an electrical socket, not shown, to emulate the way in which an ordinary electrical plug on an electrical appliance is connected by plugging into an ordinary electrical wall outlet. Further, the electrical plug 48 provides a mounting structure for the mast 44. The mast 44 is thereby mounted and further electrically connected by the plug 48. For example, the electrical socket being referred to herein, comprises a mounting recess in an outer case of a hand held personal communications device, which recess receives therein the plug 48 of the antenna assembly 40. The electrical socket being referred to herein further comprises, a printed circuit board under the mounting recess having a conducting trace thereon to which the contact of the plug 48 makes an electrical connection, when the plug 48 is plugged into the mounting recess.

A hollow cylindrical mandrel 50 at the top end of the mast 44 is of hollow, thin wall construction with an open end 52 to retain atmospheric air. The open thin wall construction provides adequate mechanical support to resist deflection and crushing while supporting the antenna element 1. The antenna element 1 is rolled into a sleeve form over the hollow cylindrical mandrel 50 of the mast 44. The mandrel 50 of the mast 44, holds the antenna element 1 in a cylindrical sleeve form, with the electrical contact 400 extending lengthwise along the mast 44 and further with the pin section 402 extending along the electrical plug 48 for making an electrical connection with an electrical socket, not shown, when the electrical plug 48 is matingly connected to an electrical socket, not shown. The mandrel 50 has an optional, slightly enlarged, smooth lip 54 at the open end 52. The lip 54 overlaps an edge of the antenna element 1 to hold the radome 42 away from the edge of the antenna element 1, and to assure that the antenna element 1 is positioned away from the open end 52.

The radome 42 is of tubular construction, closed at one end, and having a cylindrical thin wall and an open end 55 that is received over the antenna element 1 and the mast 44. The open end 55 snap fits over and interlocks with a projecting annular rib 57 on the mast 44. The thin wall constructions of both the radome 42 and the hollow cylindrical portion of the mast 44 comprise a uniformly thin area distribution of dielectric material over opposite sides of the antenna element 1 with minimized effect on antenna impedance.

Figure 16:
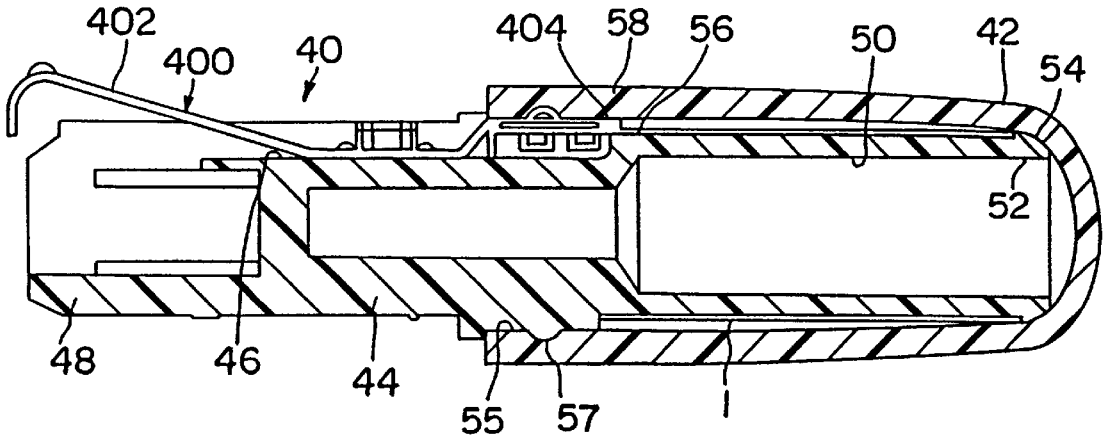
FIG. 16 is a longitudinal section view of the antenna assembly as shown in FIG. 14.
Figure 17:
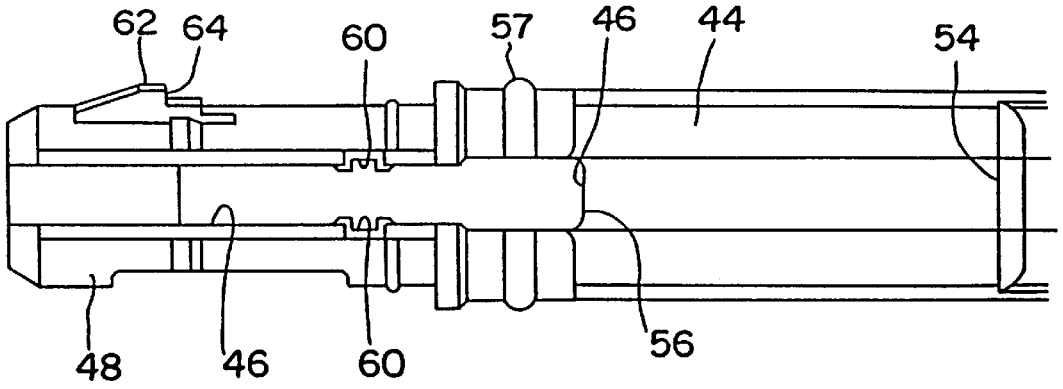
FIG. 17 is a top view of a mast of the antenna assembly as shown in FIG. 14.

With reference to FIGS. 16 and 17, the antenna mast 44 has a passage 46, also referred to as an aperture, in the form of a lengthwise groove. The passage 46 extends from a portion of the hollow cylindrical mandrel 50 that serves as a clamping section 56. With reference to FIG. 16, the crimping section 404 provides, in part, a clamped portion of the electrical contact 400 that is supported on the clamping section 56. The radome 42 has a clamping portion 58 that clamps against the clamped portion of the electrical contact 400, which retains the electrical contact 400 and the antenna feed line in position on the antenna mast 44.

Figure 15:
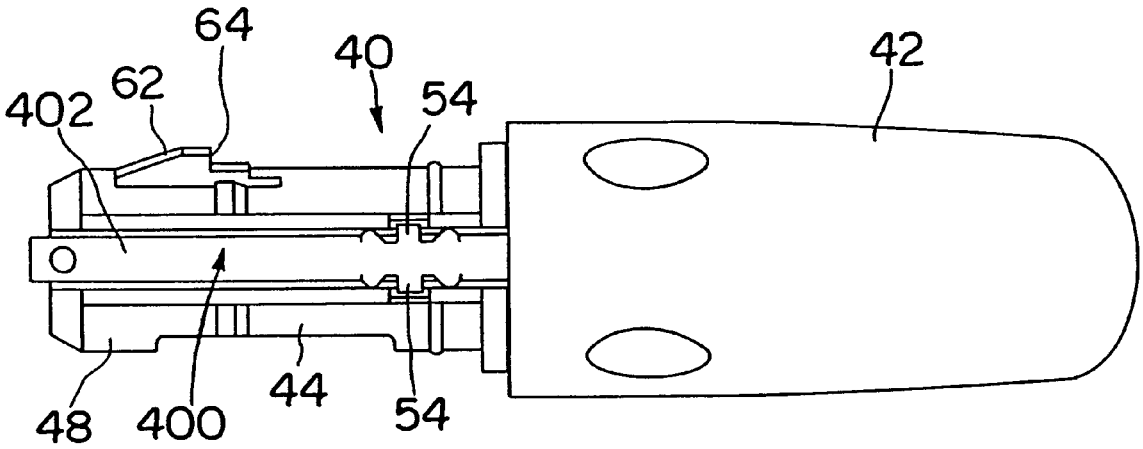
FIG. 15 is a top view of the antenna assembly as shown in FIG. 14.

The electrical contact 400 is received along the passage 46. Further, the electrical contact 400 is mounted in the passage 46 with the clamped portion of the electrical contact 400 being supported by the clamping section 56. The mast 44 has lateral channels 60, FIG. 17, that communicate with opposite sides of the passage 46. The electrical contact 400 has laterally extending barbs 54, FIG. 15, shaped to extend into the lateral channels 60 with an interference fit within the lateral channels 60, which further retains the electrical contact 400 on the antenna mast 44. The contact receiving passage 46 further extends along the electrical plug 48. The electrical contact 400 is mounted in the passage 46. The pin section 402 is a resilient spring portion of the electrical contact 400 that projects out of the passage 46 and for making an electrical connection with an electrical socket, not shown. For example, upon the resilient spring portion being plugged into the electrical socket, an electrical connection with the electrical socket is made by resilient bias of the spring portion while the spring portion engages such an electrical socket.

With reference to FIG. 17, the electrical plug 48 has a unitary projecting locking fin 62, the front of which is tapered toward an end of the electrical plug 48 for ease of entry into an electrical socket into which the electrical plug 48 is inserted. The fin 62 has a rear shoulder 64 that locks to the electrical socket to resist inadvertent unplugging of the electrical plug 48 from such an electrical socket.

Embodiments of the invention have been described. Other embodiments and modifications of the invention are intended to be covered by the spirit and scope of the appended claims.

What is claimed is:

1. An antenna assembly comprising: an antenna mast, a radiating antenna element and a radome on the antenna mast, the antenna element having an antenna feed line, an electrical contact connected to the antenna feed line, the antenna mast having a clamping section on which a clamped portion of the electrical contact is supported, and the radome having a clamping portion that clamps against the clamped portion of the electrical contact.

2. The antenna assembly as recited in claim 1 wherein the radiating antenna element is on an insulating film that is rolled in a sleeve shape.

3. The antenna assembly as recited in claim 1 wherein the radiating antenna element is on an insulating film, and a capacitive load element on the insulating film is capacitively coupled to the radiating antenna element.

4. The antenna assembly as recited in claim 1 wherein the radiating antenna element is on an insulating film that is rolled in a sleeve shape, and the insulating film has a capacitive load element capacitively coupled to the radiating antenna element.

5. The antenna assembly as recited in claim 1 wherein the antenna mast has a contact receiving passage, and the electrical contact is mounted in the passage with an interference fit.

6. An antenna assembly comprising:

an insulating antenna mast, a radiating antenna element and a radome on the insulating antenna mast, the radome covering the antenna element, the antenna element having an antenna feed line, an electrical contact connected to the antenna feed line, wherein the radiating antenna element is on an insulating film, and a capacitive load element on the insulating film is capacitively coupled to the radiating antenna element.

7. The antenna assembly as recited in claim 6 wherein the insulating film is rolled in a sleeve shape.

8. The antenna assembly as recited in claim 6 wherein the antenna mast has a contact receiving passage, the electrical contact is mounted in the passage, and a resilient spring portion of the electrical contact projects out of the passage for making an electrical connection by resilient bias of the spring portion.

9. The antenna assembly as recited in claim 1 wherein the antenna mast has a clamping section on which a clamped portion of the electrical contact is supported, and the radome has a clamping portion that clamps against the clamped portion of the electrical contact.

10. The antenna assembly as recited in claim 6 wherein the antenna mast has a contact receiving passage, the electrical contact is mounted in the passage with an interference fit, the antenna mast has a clamping section on which a clamped portion of the electrical contact is supported, and the radome has a clamping portion that clamps against the clamped portion of the electrical contact.

* * * * *